United States Patent [19]

Harrell

[11] Patent Number: 4,639,192

[45] Date of Patent: Jan. 27, 1987

[54] PROPELLER PITCH CONTROLLING ARRANGEMENT HAVING A FUEL ECONOMIZING FEATURE

[75] Inventor: David P. Harrell, Metairie, La.

[73] Assignee: American Standard Inc., Lexington, Ky.

[21] Appl. No.: 599,043

[22] Filed: Apr. 11, 1984

[51] Int. Cl.[4] ..... B63H 3/10

[52] U.S. Cl. ..... 416/27; 416/30

[58] Field of Search ..... 416/27, 25, 30

[56] References Cited

U.S. PATENT DOCUMENTS

| | | | |
|---|---|---|---|
| 2,958,381 | 11/1960 | Stevens et al. | 416/27 |
| 3,088,523 | 5/1963 | Smalley et al. | 416/27 X |
| 3,110,348 | 11/1963 | Greiner | 416/27 |
| 3,302,724 | 2/1967 | Brooks et al. | 416/27 |
| 3,589,830 | 6/1971 | Mogren et al. | 416/27 X |
| 3,639,076 | 2/1972 | Rowen | 416/30 |
| 3,724,970 | 4/1973 | Kobelt | 416/27 |
| 3,826,590 | 7/1974 | Kobelt | 416/27 |
| 4,142,829 | 3/1979 | Inoue et al. | 416/25 |
| 4,239,454 | 12/1980 | Olson | 416/27 |
| 4,436,482 | 3/1984 | Inoue et al. | 416/27 X |

FOREIGN PATENT DOCUMENTS

| | | | |
|---|---|---|---|
| 1200588 | 7/1970 | United Kingdom | 416/30 |

*Primary Examiner*—Everette A. Powell, Jr.
*Attorney, Agent, or Firm*—G. E. Hawranko

[57] ABSTRACT

A propeller pitch controlling arrangement having a fuel economizer feature for use on marine vessels, has a mode selector valve operable to a normal mode and an economizer mode. In the economizer mode, a first pilot signal is transmitted to a path selector valve to establish a first flow path to a propeller pitch servomechanism. A second pilot signal is transmitted from a relay valve when the marine vessel speed drops below a predetermined value. The second pilot signal moves the path selector valve to a second position establishing a second flow path to the propeller pitch servomechanism. A first selected fluid pressure from a regulating valve arrangement mechanically linked to the engine fuel rack, is directed to the propeller pitch servomechanism when the first flow path is established. This first selected fluid pressure is proportional to the movement to the engine fuel rack. A second selected fluid pressure, transmitted from a pitch control valve, is directed to the propeller pitch servomechanism when the second flow path is established.

6 Claims, 1 Drawing Figure

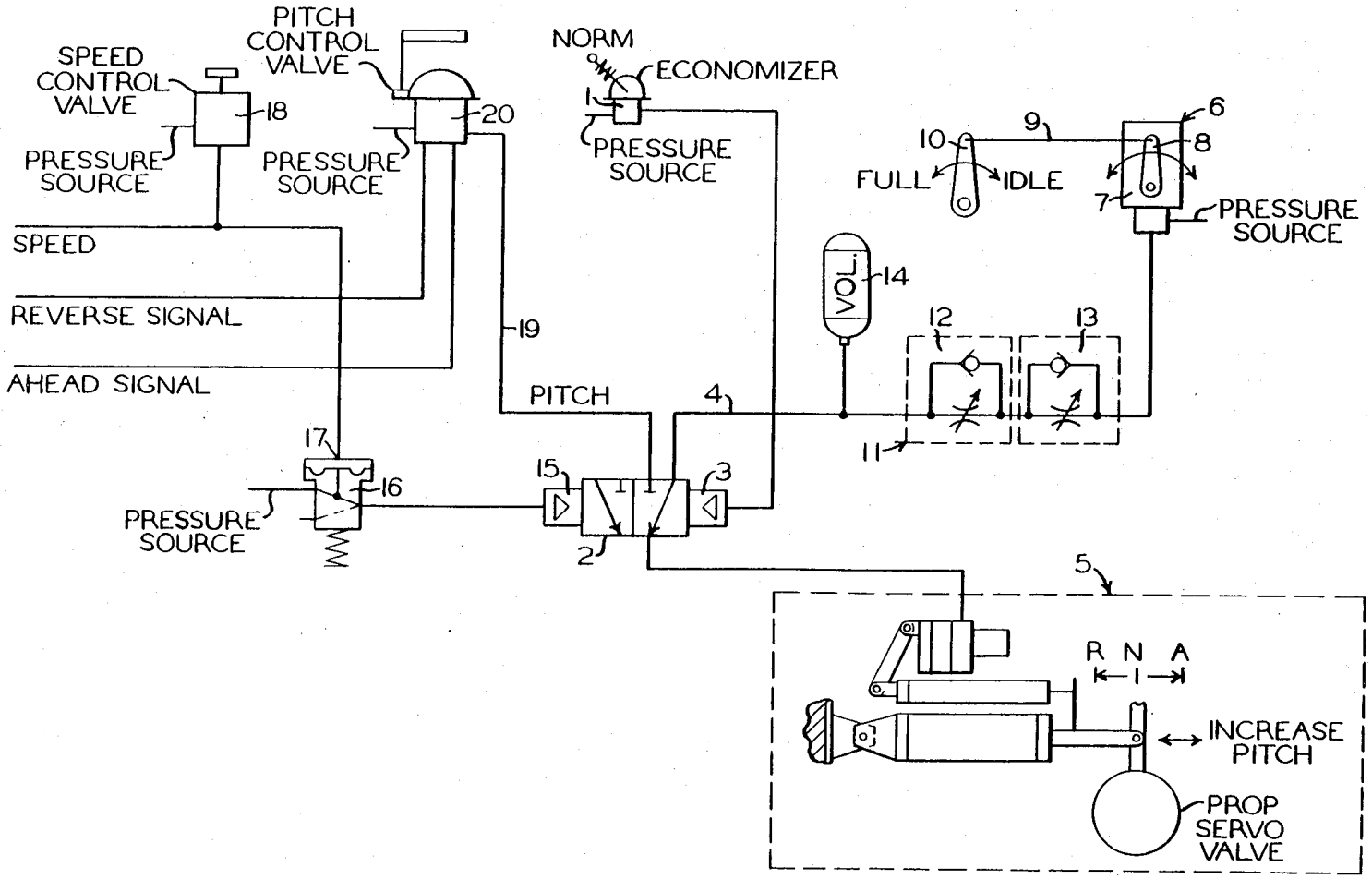
PRESSURE SOURCE
6
8
7
9
IDLE
10
FULL
13
12
11
14
VOL
ECONOMIZER
NORM
1
PRESSURE SOURCE
4
3
2
PITCH
15
19
20
PITCH CONTROL VALVE
PRESSURE SOURCE
18
SPEED CONTROL VALVE
PRESSURE SOURCE
SPEED
REVERSE SIGNAL
AHEAD SIGNAL
16
17
PRESSURE SOURCE
5
R N A
INCREASE PITCH
PROP SERVO VALVE

PROPELLER PITCH CONTROLLING ARRANGEMENT HAVING A FUEL ECONOMIZING FEATURE

BACKGROUND OF THE INVENTION

This invention relates to an arrangement for controlling the pitch of a propeller used on marine diesel motor vessels. More particularly, a propeller pitch controlling arrangement which is operable to a fuel economizer mode whereby the propeller pitch is regulated to obtain optimum performance of the engine under any throttle setting. Typically, propeller pitch controlling arrangements have provided for regulating the pitch of the propeller only in the event of an overload on the engine. One such load monitoring propeller pitch controlling arrangement can be found in U.S. Pat. No. 3,443,587, assigned to the assignee of the present application. A load sensing valve in the previously mentioned patent uses a double acting power cylinder subjected to opposing load sensing and speed control pressures to regulate the propeller pitch. Such an arrangement is not selectively operated nor does it act to maximize fuel efficiency and engine performance; the propeller pitch therefore is varied as a function of a predetermined overload pressure. Still other propeller pitch controlling arrangements have attempted to control the propeller pitch to achieve an efficient use of fuel; however, such applications typically have provided a pitch signal dependent on secondary data such as, for example, exhaust temperature, fuel flow and RPMs. The propeller pitch controlling arrangements which use the abovementioned secondary data have the disadvantage that the equipment necessary to detect and analyze such secondary data is expensive and a further disadvantage that the pitch controlling signal does not accurately and quickly control the system.

SUMMARY OF THE INVENTION

It is, therefore, an object of the invention to provide a propeller pitch controlling arrangement which has a fuel economizer mode for optimum engine performance regardless of the throttle setting.

It is a further object of the invention to provide a propeller pitch controlling arrangement which quickly and accurately responds to changes in the engine load.

Yet another object of the invention is to provide such a quick response type propeller pitch controlling arrangement by basing the operation on the use of primary performance characteristics.

An even further object of the invention is to provide a propeller pitch controlling arrangement using the minimum number of components thereby minimizing manufacture and maintenance costs.

Briefly, the invention consists of a manually operable selector valve having a normal mode and an economizer mode. The manual selector valve outputs a pulse-type signal pressure when the economizer mode has been selected. The signal pressure is transmitted to a first pilot input of a dual-pilot controlled 3/2-way selector valve used to establish the fluid flow paths to the propeller pitch servomechanism. The first flow path, corresponding to the economizer mode, allows fluid pressure to be directed to the servomechanism from an economizer valve arrangement. The economizer valve arrangement includes a precision regulating valve having an operator member mechanically linked to a lever on the engine fuel rack. A linking rod connected between the operator member and rack lever can be adjusted to provide a sensitivity setting for the precision regulating valve response to rack movement. A pair of oppositely disposed flow regulating, check valve configurations are located in the pressure line leading from the precision regulating valve. The regulating/check valve configurations provide for a timing adjustment for the pressurizing of a volume which, taken together, act as a signal dampening circuit for preventing pulsation of the economizer fluid pressure transmitted from the precision regulating valve. In the normal mode, the fluid pressure supplied to the propeller pitch servomechanism is transmitted from a pitch setting valve over the second position of the flow path selector valve. This second position is achieved when a second pilot pressure is transmitted to a second pilot portion of the flow path selector valve. The second pilot pressure is transmitted from a relay valve when the speed pressure transmitted from a speed control valve is at a predetermined value.

BRIEF DESCRIPTION OF THE DRAWING

FIG. 1 is a diagrammatical representation of a propeller pitch controlling arrangement constructed in accordance with the invention.

DESCRIPTION AND OPERATION

As seen in FIG. 1, the propeller pitch controlling arrangement with a fuel economizer feature has a manually operable mode selector valve 1 operable to either a normal mode or an economizer mode. The mode selector valve 1 has a spring return handle 1*a* which returns the mode selector valve 1 to the normal position. If the mode selector valve 1 is in the normal mode, no fluid pressure is transmitted; only when the mode selector valve 1 has been moved to the economizer mode is there an output. In the economizer mode, the mode selector valve 1 outputs a first pilot signal pressure which is in the form of a pulse-type pressure. The first pilot signal pressure is communicated to a first pilot portion 3 of a dual-pilot controlled 3/2-way selector valve 2. The dual-pilot controlled 3/2-way selector valve 2 is operated to the first of two positions by the first pilot signal pressure. Such first selector valve position establishes a first fluid flow path 4 whereby fluid pressure corresponding to an economizer mode operation flows therethrough. Fluid pressure flowing over this first fluid flow path 4 is directed to a propeller pitch servomechanism 5 which sets the propeller pitch according to the magnitude of the fluid pressure communicated thereto.

Fluid pressure flowing over the first fluid flow path 4 originates from an economizer valve arrangement shown generally at 6. A precision regulating valve 7 regulates a fluid pressure output according to the position of a regulating handle 8 which is mechanically linked by a linking rod 9 to a rack lever 10. The rack lever 10 is the portion of the engine fuel rack (not shown) that most accurately and instantly indicates the fuel requirements of the engine 1 (not shown) based on the governor setting and engine load. The length of the linking rod 9 can be adjusted to provide a sensitivity adjustment for the precision regulating valve 7 in response to movement of the rack lever 10. The connection between the rack lever 10 and regulating handle 8 is such that a decreasing movement of the fuel rack (not shown) causes a proportional increase in fluid pressure transmitted from the precision regulating valve 7.

The fluid pressure flowing through the precision regulating valve 7 flows first through a pulsation dampening circuit shown generally at 11. The pulsation dampening circuit 11 includes two oppositely disposed, flow regulator, check valve configurations 12, 13 and a reservoir 14. The flow regulator, check valve configurations 12, 13, hereinafter referred to as flow regulators 12, 13, act as a timing adjustment means for the charging of the reservoir 14 with fluid pressure from the precision regulating valve 7. In this manner, the flow regulators 12, 13 and reservoir 14 act as a dampener to prevent pulsation or harmonics on the fluid pressure transmitted from the pressure regulating valve 7.

In order to maintain the economizer mode operation, the speed of the vessel, indicated by a speed control pressure, must be less than a predetermined threshold level which can be referred to as an override fluid pressure level. Given that the first pilot signal pressure is in the form of a pulse-type pressure, a second pilot signal pressure, essentially in the form of a steady fluid pressure, presented to a second pilot portion 15 of the flow path selector valve 2, will operate the flow path selector valve 2 to a second position corresponding to the normal mode of vessel operation.

The second pilot signal pressure is transmitted from a throttle signal valve 16. The throttle signal valve 16 is a relay-type valve which operates to allow the flow of fluid pressure therethrough provided a fluid pressure value presented to a trigger input 17 of the throttle signal valve 16, does not exceed a predetermined value. The fluid pressure presented to the trigger input 17 is the speed pressure signal which is transmitted from the speed control valve 18. In this manner, it can be appreciated that the speed control valve 18 not only controls the vessel speed, but also ensures that the vessel has achieved at least a cruising speed before allowing the economizer mode to be turned on. If the speed pressure signal is below such predetermined speed pressure value, the throttle signal valve 16 will operate to a position whereby fluid pressure is directed to the second pilot portion 15 of the flow path selector valve 2 thereby preventing engagement of the economizer mode.

With the flow path selector valve 2 in the second position by the operation of the throttle signal valve 16 and/or the absence of the first pilot signal pressure, fluid pressure is directed over a second flow path 19 to the propeller pitch servomechanism 5. The fluid pressure supplied over the second flow path 19 is transmitted from a pitch/direction control valve 20.

In operation, it is assumed that the vessel has achieved at least cruising speed thereby operating the throttle signal valve 16 to a position resulting in the absence of the second pilot signal pressure. The vessel operator then operates the mode selector valve 1 to the economizer mode resulting in the transmission of the pulse-type first pilot signal pressure to the first pilot position 3 of the flow path selector valve 2. The flow path selector valve 2 is therefore moved to the first position to establish the first flow path 4 to the propeller pitch servomechanism 5. Fluid pressure is then transmitted over the first flow path 4 from the precision regulating valve 7 at a level determined by the fuel rack setting. The precision regulating valve 7 at all times, outputs a fluid pressure level which is a function of the position of the rack lever 10 which, in turn, reflects conditions of the engine load and governor setting parameters and is a primary indication of the vessel power consumption. The relationship between the fuel rack (not shown) and the precision regulating valve 7 is such that, movement of the rack lever 10, transmitted over the linking rod 9 to the regulating handle 8, is inversely proportional to the fluid pressure output of the precision regulating valve 7. In other words, movement of the fuel rack to a decreasing power setting results in an increase in the fluid pressure level output from the precision regulating valve 7.

Prior to flowing through the flow path selector valve 2, the fluid pressure transmitted through the precision regulating valve 7 is conditioned by the pulsation dampening circuit 11 to remove any pulse or harmonic conditions which may result from sudden changes in the fuel rack position.

In order to return to the normal control mode of vessel operation, the operator will reduce the throttle setting as necessary in the instance of approaching a docking facility. With the throttle setting so reduced, the throttle signal valve 16 will operate to a position whereby the second pilot signal pressure will be directed to the second pilot portion 15 of the flow path selector valve 2. The flow path selector valve 2 will then establish the second flow path 19 allowing fluid pressure from the pitch/direction control valve 20 to be directed to the propeller pitch servomechanism 5. The flow path selector valve 2 will remain in this position, regardless of the speed pressure signal transmitted from the speed control valve 18, until the economizer mode is again selected by the operation of the mode selector valve 1 and at least a cruise speed exists. Though the above discussion has presented a propeller pitch controlling arrangement having a fuel economizer feature whereby the system operates on pneumatics, other alternatives for practicing the invention are contemplated as well. For example, electromagnetic or hydraulic devices can be used in place of the pneumatic devices shown.

I claim:

1. A propeller pitch controlling arrangement having a fuel economizer feature for use on marine vessels having an engine fuel rack and a variable pitch propeller, said propeller pitch controlling arrangement comprising:

(a) a pitch controlling servomechanism operably engaged to the variable pitch propeller such that the pitch of the variable pitch propeller is controlled as a function of the amount of fluid pressure delivered thereto;

(b) a fluid steering valve connected to said pitch controlling servomechanism and operable to one of a first and second valve position wherein fluid pressure from one of associated respective first and second flow paths is directed to said pitch controlling servomechanism;

(c) said fluid steering valve having respective first and second pilot operated portions which, when actuated by respective first and second pilot signals, effect movement to such first and second valve positions, such first and second valve positions being mutually exclusive in operation;

(d) a relay valve receptive of fluid pressure having a value determined by the marine vessel speed, said relay valve being connected to said first pilot portion of said fluid steering valve such that, upon reduction of such speed determined fluid pressure below a preselected value, such first pilot signal is transmitted to said fluid steering valve and said first flow path is established thereby;

(e) a pitch control valve manually operable over a range of fluid pressure delivery settings such that, when said first flow path is established, a first operating fluid pressure is transmitted thereover to said pitch controlling servomechanism;

(f) a mode selector valve manually operable to an economizer position and spring returnable to a normal position, such operation to the economizer position effecting a pulse-type transmission of such second pilot signal to said second pilot portion of said fluid steering valve such that said second flow path is established thereby;

(g) economizer valve means mechanically linked to such marine vessel engine fuel rack for transmitting a second operating fluid pressure to said pitch controlling servomechanism when said second flow path is established, such second operating fluid pressure being in inverse proportion to movement of such marine vessel engine fuel rack; and (h) such first pilot signal being continuous in duration when such speed determined fluid pressure has been reduced below such preselected value, such first pilot signal thereby overriding such pulse-type second pilot signal in the event such first and second pilot signal occur simultaneously.

2. A propeller pitch controlling arrangement, as set forth in claim 1, further comprising a signal dampening means disposed in said second flow path for conditioning such second operating fluid pressure such that pulsations and harmonics in such second operating fluid pressure are removed, said signal dampening means including two oppositely disposed, flow regulating valve/check valve arrangements and a reservoir.

3. A propeller pitch controlling arrangement, as set forth in claim 1, wherein said economizer valve means includes a pressure regulating valve and a regulating handle operably connected to said precision regulating valve and mechanically linked to such marine vessel engine fuel rack by a linking rod.

4. A propeller pitch controlling arrangement, as set forth in claim 1, wherein said fluid steering valve is a dual-pilot controlled, three-way, two-position directional valve.

5. A propeller pitch controlling arrangement, as set forth in claim 1, wherein said relay valve is adjustable such that, transmission of such first pilot signal pressure occurs as such speed determined fluid pressure falls below one of a plurality of preselectable values.

6. A propeller pitch controlling arrangement, as set forth in claim 3, wherein the length of said linking rod can be adjusted such that, the proportional relationship between such second operation fluid pressure transmitted from said precision regulating valve and such marine vessel engine fuel rack movement is adjustable.

* * * * *